US006919683B1

(12) United States Patent
Jang

(10) Patent No.: US 6,919,683 B1
(45) Date of Patent: Jul. 19, 2005

(54) HIGH-BRIGHTNESS PHOSPHOR SCREEN AND METHOD FOR MANUFACTURING THE SAME

(75) Inventor: Jae-eun Jang, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 494 days.

(21) Appl. No.: 09/702,850

(22) Filed: Nov. 1, 2000

(30) Foreign Application Priority Data

Nov. 1, 1999 (KR) ..... 1999-47964

(51) Int. Cl.[7] ..... H01J 1/62
(52) U.S. Cl. ..... 313/503; 252/301.6 S
(58) Field of Search ..... 313/503; 252/301.6 S, 252/301.6 R

(56) References Cited

U.S. PATENT DOCUMENTS 4,424,467 A 1/1984 Masuda et al.
6,163,108 A 12/2000 Toki et al.

FOREIGN PATENT DOCUMENTS

| | | |
|---|---|---|
| JP | 52 030276 | 3/1977 |
| JP | 52 030277 | 3/1977 |
| JP | 08 055592 | 2/1996 |
| JP | 08 100174 | 4/1996 |
| JP | 10 302686 | 11/1998 |
| JP | 11 167868 | 6/1999 |

OTHER PUBLICATIONS

Mori Hideto, Jun. 22, 1999, JP 11–167868.*
Wagner et al., "Recent Developments in Low Voltage FED Phosphors," Georgia Tech Research Institute Journal of Technology, Sep. 1997.
Blasse et al., "Luminescent Materials," Springer Verlag Berlin Heidelberg, pp. 137 and 138, 1994.
"Phosphor Screens," Proxitronic, pp. 1–5 (available from www.proxitronic.de).

* cited by examiner

*Primary Examiner*—Edward J. Glick
*Assistant Examiner*—Jurie Yun
(74) *Attorney, Agent, or Firm*—Burns Doane, Swecker & Mathis, LLP

(57) ABSTRACT

A high-brightness phosphor screen and a method for forming the same are provided. The high-brightness phosphor screen having a low or middle working voltage, unlike a method of improving luminescent properties by use of a new synthetic phosphor, can be formed by simple deposition of a phosphor mixture that contains a proper ratio of a blue or green light-emitting phosphor for color image display and a bluish green light-emitting ZnO:Zn phosphor with high luminescent efficiency at low voltages.

6 Claims, 3 Drawing Sheets

(2 of 3 Drawing Sheet(s) Filed in Color)

FIG. 3A
그림3
ZnS:Ag,Cl + 6.66%ZnO::Zn
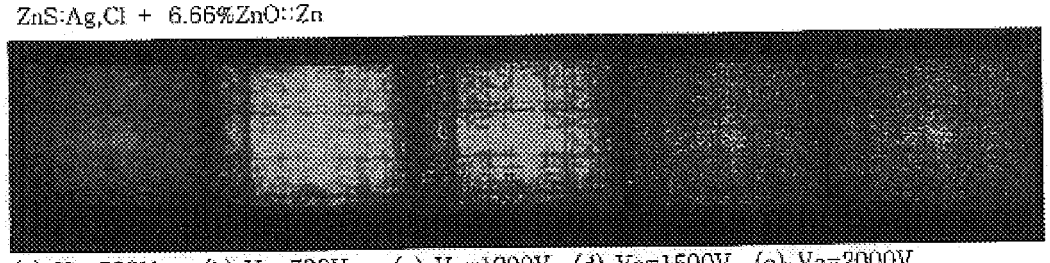
(a) Va=500V (b) Va=700V (c) Va=1000V (d) Va=1500V (e) Va=2000V
ZnS:Ag:Cl
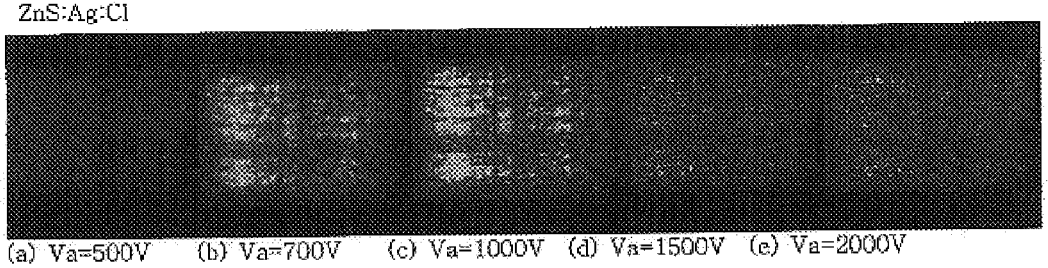
(a) Va=500V (b) Va=700V (c) Va=1000V (d) Va=1500V (e) Va=2000V
FIG. 3B

HIGH-BRIGHTNESS PHOSPHOR SCREEN AND METHOD FOR MANUFACTURING THE SAME

BACKGROUND OF THE INVENTION

1. Field of the Invention

The present invention relates to a high-brightness phosphor screen for use in luminescent displays using phosphors, and a method for manufacturing the same, and more particularly, to a phosphor screen capable of emitting light with high brightness at a low or middle level voltage, and a method for manufacturing the same.

2. Description of the Related Art

In luminescent displays, such as cathode ray tubes (CRTs), vacuum fluorescent displays (VFDs), field emission displays (FEDs), phosphor serves to form an image from an electrical signal by emitting light after having been excited by low incident electrons. Phosphor exhibits an intrinsic color depending on its composition, and its color and brightness vary according to the energy and thee number of electrons bombarding the surface of phosphor. Here, the energy and the number of electrons which bombard a phosphor screen are determined by the structure and the operation type of a driving unit.

Until now, research into phosphor has been focused on high-voltage phosphors excitable with a few tens of kilovolts for use in CRTs, and low-voltage phosphors excitable with a few hundred volts for use in VFDs. With an increasing interest in FEDs which are driven by a middle level of voltage of 1–4 kW, there is a need for a phosphor for effective use in such a display with application of a middle level voltage.

When an existing high-voltage phosphor for CRTs is excited with a middle level of voltage, the excitation energy of electrons is lower than with a high voltage, so that a larger electron current than for a CRT is needed to give the same brightness due to reduced luminescent efficiency. However, the application of a high current reduces the lifetime of the phosphor, and thus it would be desirable to increase the luminescent efficiency at a middle level working voltage without increasing the current.

ZnO:Zn phosphors, which are known as a type of phosphor having a high luminescent efficiency at low voltages, emit blueish green light with a major emission peak near 505 nm. For this reason, in spite of the advantage of a high brightness with a low or middle level working voltage and reduced power consumption, ZnO:Zn phosphors are unsuitable for displaying a color image, and thus their applications have been limited to black-and-white image displays.

To increase the driving efficiency at a middle level voltage, i.e., to enhance the brightness at a middle level voltage, U.S. Pat. No. 5,788,881 discloses a method of forming a phosphor screen with a mixture of two phosphors having different conductivities. In particular, the conductivity of the entire phosphor screen is increased using the conductivity of a low-voltage phosphor, thereby enhancing the brightness characteristics.

However, there is still a need for a phosphor applicable in displaying color images with enhanced color purity and high luminescent efficiency at a middle level working voltage.

SUMMARY OF THE INVENTION

To solve the above problems, it is an objective of the present invention to provide a phosphor screen which has a high brightness with a low or middle level working voltage, and in which a small amount of a ZnO:Zn phosphor is used, and a method of manufacturing the same.

According to an aspect of the present invention, there is provided a high-brightness phosphor screen, comprising: a luminescent material for emitting light of a predetermined color, used for color image display; and a ZnO:Zn phosphor capable of enhancing the brightness of the display, wherein the mixing ratio of the luminescent material to the ZnO:Zn phosphor is varied according to a desired level of brightness.

Preferably, the luminescent material is a blue or green light-emitting phosphor. The blue light-emitting phosphor may be at least one sulfide based phosphor selected from the group consisting of ZnS:Ag,Cl, ZnS:Ag,Cl,Al, (Zn,Cd)S:Ag, ZnS:Ag,Cl,Al,Mg, (Zn,Cd)S:Ag,Cl, (Zn,Cd)S:Ag,Cl,Al, and (Zn,Cd)S:Ag,Cl,Mg. The green light-emitting phosphor may be at least one sulfide based phosphor selected from the group consisting of ZnS:Cu,Al, ZnS:Cu, ZnS:Cu,Al,Au, (Zn,Cd)S:Cu,Al, (Zn,Cd)S:Cu and (Zn,Cd)S:Cu,Al,Au. Preferably, the amount of the ZnO:Zn phosphor added is 20% or less by weight based on the weight of the luminescent material.

According to another aspect of the present invention, there is provided a method-for forming a high-brightness phosphor screen by mixing a luminescent material for emitting light of a predetermined color and a predetermined amount of a ZnO:Zn phosphor, the method comprising the steps of: (a) preparing a phosphor mixture solution by dispersing the luminescent material and the ZnO:Zn phosphor in a solvent; (b) forming a phosphor layer by depositing the phosphor mixture solvent on a substrate; and (d) evaporating the solvent from the deposited phosphor layer.

Preferably, in step (a), the luminescent material is a blue or green light-emitting phosphor. The blue light-emitting phosphor may be at least one sulfide based phosphor selected from the group consisting of ZnS:Ag,Cl, ZnS:Ag,Cl,Al, (Zn,Cd)S:Ag, ZnS:Ag,Cl,Al,Mg, (Zn,Cd)S:Ag,Cl, (Zn,Cd)S:Ag,Cl,Al, and (Zn,Cd)S:Ag,Cl,Mg. The green light-emitting phosphor may be at least one sulfide based phosphor selected from the group consisting of ZnS:Cu,Al, ZnS:Cu, ZnS:Cu,Al,Au, (Zn,Cd)S:Cu,Al, (Zn,Cd)S:Cu and (Zn,Cd)S:Cu,Al,Au. Preferably, the amount of the ZnO:Zn phosphor added is 20% or less by weight based on the weight of the luminescent material.

Preferably, in step (b), the phosphor layer is formed by depositing the phosphor mixture solution on the substrate with the application of electrophoresis, screening, photolithography or precipitation.

BRIEF DESCRIPTION OF THE DRAWINGS

The file of this patent application contains at least one drawing executed in color. Copies of this patent with color drawing(s) will be provided by the Office upon request and payment of the necessary fee.

The above objective and advantages of the present invention will become more apparent by describing in detail a preferred embodiment thereof with reference to the attached drawings in which:

FIGS. 3A and 3B illustrate the luminescence of an image at various accelerating voltages from a field emission display which adopts a phosphor screen formed with a mixture of a blue light-emitting ZnS:Ag,Cl phosphor and a ZnO:Zn phosphor in a concentration of 6.66% by weight, and a field emission display which adopts a phosphor screen formed of only the blue light-emitting ZnS:Ag,Cl phosphor, respectively.

DETAILED DESCRIPTION OF THE INVENTION

A phosphor screen which shows a high brightness at a low or middle level of working voltage according to the present invention is characterized by enhanced luminescent efficiency. In particular, a small amount of a ZnO:Zn phosphor, which has high luminescent efficiency at low voltages, is mixed with a green or blue light-emitting phosphor, so that a high-brightness image can be displayed with reduced power consumption. The following are considerations to achieve the high-brightness image display.

Figure 1:
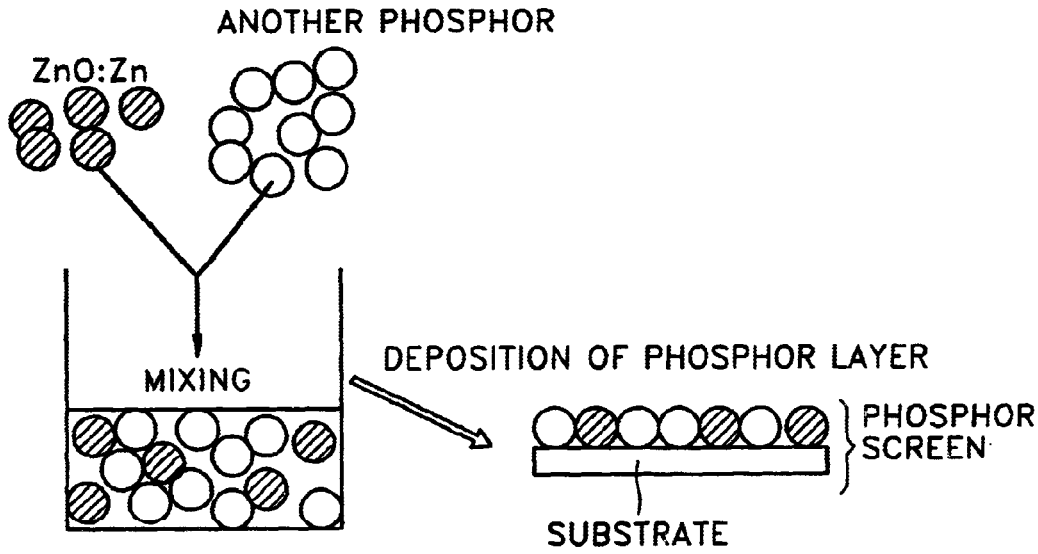
FIG. 1 illustrates a method of forming a high-brightness phosphor screen excitable with application of a middle level working voltage according to the present invention.

ZnO:Zn phosphors exhibit a major emission peak near 505 nm, and thus bluish green light is emitted from the phosphors. For this reason, it is difficult to display a color image with ZnO:Zn phosphors. Accordingly, in the present invention, as shown in FIG. 1, a luminescent material such as a sulfide based pure green or pure blue light-emitting phosphor, which is for use in displaying a color image, is mixed with a ZnO:Zn phosphor in an appropriate ratio to form a phosphor screen, with enhanced brightness and color purity properties.

Preferably, the blue light-emitting luminescent material mixed with the ZnO:Zn phosphor is a sulfide based phosphor selected from the group consisting of ZnS:Ag,Cl, ZnS:Ag,Cl,Al, (Zn,Cd)S:Ag, ZnS:Ag,Cl,Al,Mg, (Zn,Cd)S:Ag,Cl, (Zn,Cd)S:Ag,Cl,Al, and (Zn,Cd)S:Ag,Cl,Mg. The green light-emitting luminescent material may be a sulfide based phosphor selected from the group consisting of ZnS:Cu,Al, ZnS:Cu, ZnS:Cu,Al,Au, (Zn,Cd)S:Cu,Al, (Zn,Cd)S:Cu and (Zn,Cd)S:Cu,Al,Au.

The amount of the ZnO:Zn phosphor used can be varied depending on a desired level of brightness, but is preferably 20% by weight based on the weight of the luminescent material in order to optimize luminescent efficiency and color purity.

The high-rightness phosphor screen excitable with a low voltage according logy to the present invention is formed of a mixture of a ZnO:Zn phosphor, which is excitable with a low working voltage, and another phosphor suitable for good color image display. As a result, a color image with enhanced brightness and color properties can be obtained with the phosphor screen at a low or middle level working voltage.

As shown in FIG. 1, a ZnO:Zn phosphor and another phosphor are dispersed in a solvent, so that a phosphor solution is obtained. The phosphor solution is deposited on a substrate by electrophoresis, screening, photolithography and precipitation, to form a phosphor layer. Then, the solvent is removed from the phosphor layer by evaporation, so that a phosphor screen including heterogeneous phosphors is completed. As electrons strike the surface of the phosphor screen, a color image is displayed.

The high-brightness phosphor screen for image display according to the present invention has advantages in that brightness properties can be enhanced by mixing a ZnO:Zn phosphor with high luminescent efficiency at low voltages with another phosphor (preferably, a blue or green light-emitting phosphor suitable to display a color image), and the color properties can also be improved by the use of blue or green-light emitting phosphor of a similar color.

Figure 2:
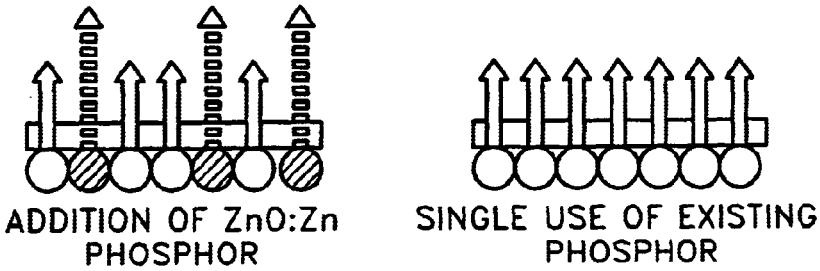
FIG. 2 illustrates the principle of brightness increase by addition of a ZnO:Zn phosphor in the formation of the high-brightness phosphor screen illustrated in FIG. 1.

FIG. 2 illustrates the luminescent properties of phosphor when a single existing phosphor is used to form a phosphor screen, and when a ZnO:Zn phosphor is further added to form the phosphor screen. As shown in FIG. 2, when the phosphor screen is formed with the mixture of the existing blue or green phosphor and the ZnO:Zn phosphor, the high luminescent efficiency of the ZnO:Zn phosphor at a middle level working voltage in the range of 1–5 kV can be enhanced due to luminescence of the blue or green phosphor added. In other words, since the ZnO:Zn phosphor has the intrinsic color of bluish green, the addition of the ZnO:Zn phosphor to the existing blue or green phosphor does not adversely affect the color of the display image.

The brightness and color of a display image can be easily controlled as needed according to various operating conditions, by adjusting the amount of ZnO:Zn phosphor For example, for more enhanced brightness properties than color properties, the amount of ZnO:Zn phosphor is increased. In contrast, for better color properties, the ZnO:Zn phosphor is added in a small amount. As a result, desired luminescence properties can be obtained.

FIGS. 3A and 3B illustrate the luminescence of an image at various accelerating voltages from a field emission display which adopts a phosphor screen formed with a mixture of a blue light-emitting ZnS:Ag,Cl phosphor and a ZnO:Zn phosphor in a concentration of 6.66% by weight, and a field emission display which so adopts a phosphor screen formed of only the blue light-emitting ZnS:Ag,Cl phosphor, respectively. As shown in FIGS. 3A and 3B, enhanced brightness is achieved in the case where the ZnO:Zn phosphor is added, compared with the case where no ZnO:Zn phosphor is added.

As for the color of displayed images, due to high luminescent efficiency of the ZnO:Zn phosphor at low working voltages, the color purity can be diminished by the addition of the ZnO:Zn phosphor. However, with the application of higher accelerating voltages, the luminescent characteristics of the ZnS:Ag,Cl phosphor are improved. As a result, the color purity of the image formed by excitation of the heterogeneous phosphors including ZnO:Zn phosphor and ZnS:Ag,Cl phosphor is similar to that from the single phosphor, Zn:Ag,Cl phosphor, at accelerating voltages of 1.5 kV or more. Evidence of this is shown in Table 1 below. Thus, the inventive phosphor screen can be used for color image display.

Figure 4:
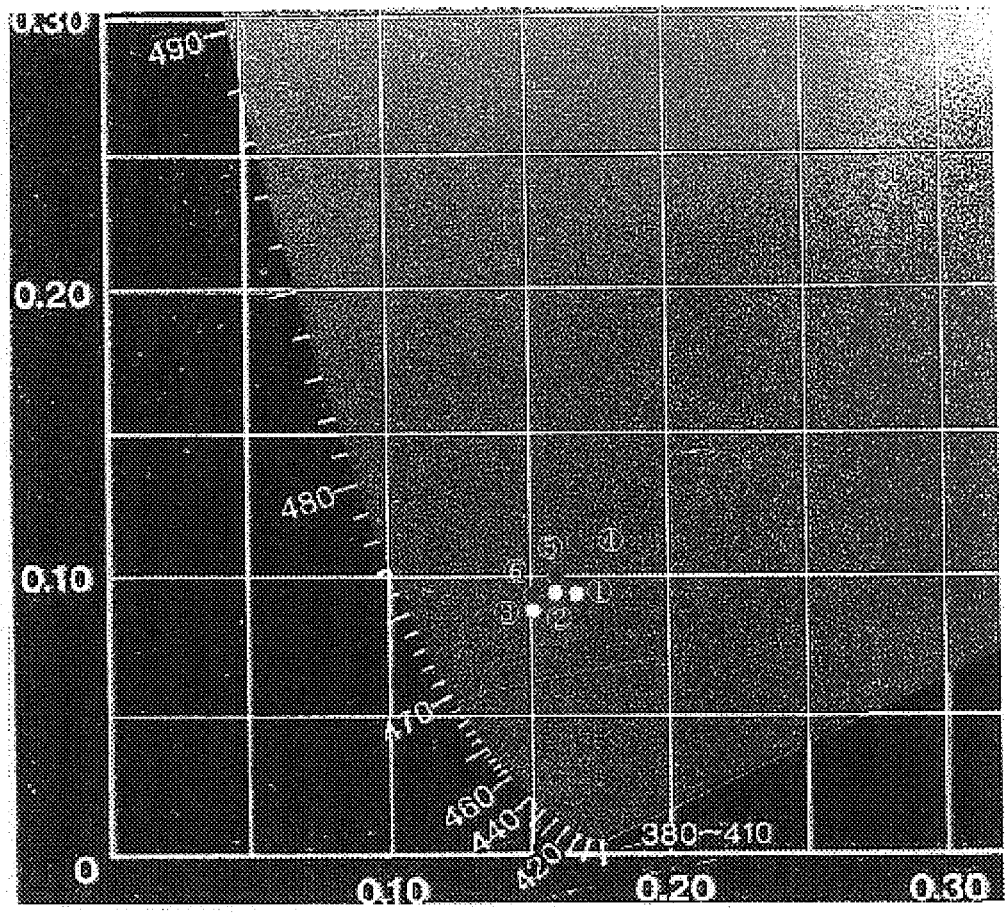
FIG. 4 illustrates the chromaticity coordinates of the images shown in FIGS. 3A and 3B.

FIG. 4 illustrates the chromaticity coordinates of images shown in FIGS. 3A and 3B. Table 1 shows the brightness values and the chromaticity coordinates of images displayed under the conditions described above with reference to FIGS. 3A and 3B. In Table 1, x and y indicate the x- and y-coordinates of points on the graph of FIG. 4. Also, the six coordinates indicated by symbols ①, ②, ③, ④, ⑤ and ⑥ in FIG. 4 are for the images displayed under the operating conditions indicated by the same symbols in Table 1.

TABLE 1

| Amount of ZnO:Zn phosphor (% by weight) | Accelerating voltage (Va) 500 V | 700 V | 1000 V | 1500 V | 2000 V |
|---|---|---|---|---|---|
| 0 | 5.78 cd/m$^2$<br>x = 0.24<br>y = 0.21 | 9.77 cd/m$^2$<br>x = 0.19<br>y = 0.15 | 17.3 cd/m$^2$<br>x = 0.17<br>y = 0.09<br>① | 33.7 cd/m$^2$<br>x = 0.16<br>y = 0.09<br>② | 54.6 cd/m$^2$<br>x = 0.1556<br>y = 0.0829<br>③ |
| 6.66 | 6.99 cd/m$^2$<br>x = 0.25<br>y = 0.23 | 15.6 cd/m$^2$<br>x = 0.19<br>y = 0.15 | 29.3 cd/m$^2$<br>x = 0.17<br>y = 0.12<br>④ | 53.5 cd/m$^2$<br>x = 0.16<br>y = 0.10<br>⑤ | 85.6 cd/m$^2$<br>x = 0.15<br>y = 0.09<br>⑥ |

As shown in FIG. 4, the chromaticity coordinates for the cases indicated by the symbols ①, ② and ③, where ZnO:Zn phosphor is not added, are close to those go for the cases indicated by the sample ④, ⑤ and ⑥, where ZnO:Zn phosphor is further used to form the phosphor screen. Thus, it is apparent that the color of images is not significantly influenced by addition of the ZnO:Zn phosphor.

The high-brightness phosphor screen operable with a low or middle voltage according to the present invention is advantageous in that the brightness can be enhanced using the high luminescent efficiency of the ZnO:Zn phosphor, and the color properties of an existing phosphor used for color image display remain. Thus, the inventive phosphor screen is applicable as a blue or green light-emitting phosphor screen with enhanced color properties at a low or middle level working voltage. The phosphor screen according to the present invention is similar to the disclosure of U.S. Pat. No. 5,788,881, in that a mixture of two phosphors is used to form the phosphor screen with enhanced brightness properties. However, in contrast to the prior art which has improved brightness by increasing the conductivity of the entire phosphor layer based on the conductivity of one phosphor excitable with low voltages, the enhanced brightness properties of the inventive phosphor screen are based on the high luminescent efficiency of a component phosphor having a low working voltage. As another distinction between the present invention and the prior art is that in the inventive phosphor screen, the color properties of the other phosphor added for the purpose of color display are maintained, so that a high quality color image can be displayed using the phosphor layer containing the phosphor mixture. Furthermore, the types of phosphors used in the present invention are different from those of the prior art.

As previously mentioned, the high-brightness phosphor screen having a low or middle level working voltage according to the present invention, unlike a conventional method of improving luminescent properties by use of a new synthetic phosphor, can be formed by simple deposition of a phosphor mixture that contains a proper ratio of a blue or green light-emitting phosphor for color image display and a bluish green light-emitting ZnO:Zn phosphor with high luminescent efficiency at low voltages. Thus, reduction of the lifespan of a phosphor, which would occur by the application of high current to increase brightness, can be prevented. In addition, display of a blue or green color image can be achieved at a low or middle level working voltage with enhanced brightness. Advantages of the phosphor screen according to the present invention are as follows.

First, by use of the mixture of a blue or green light-emitting phosphor and a ZnO:Zn phosphor, the luminescent characteristics of the blue or green light-emitting phosphor at low working voltages are enhanced by the high luminescent efficiency of the ZnO:Zn phosphor, so that an image with enhanced brightness can displayed with application of a low or middle level voltage.

Second, since the ZnO:Zn phosphor emits bluish green light, the color purity of the blue or green light-emitting phosphor that is used for color display can be maintained by adjusting the amount of the ZnO:Zn phosphor added. That is, display of a colored image is possible by the inventive phosphor screen.

Third, the brightness properties can be easily improved by just mixing phosphors, rather than by a complicated phosphor synthesis or surface treatment technique.

Fourth, the brightness and color of an image to display can be easily controlled according to various operating conditions, by adjusting the amount of the ZnO:Zn phosphor. In particular, if the brightness of an image is considered more than the color, the amount of ZnO:Zn phosphor is increased. For the opposite case, a small amount of ZnO:Zn phosphor is added. By doing so, desired luminescent properties of an image can be implemented.

While this invention has been particularly shown and described with reference to preferred embodiments thereof, it will be understood by those skilled in the art that various changes in form and details may be made thereto without departing from the spirit and scope of the invention as defined by the appended claims.

What is claimed is:

1. A high-brightness phosphor screen, comprising:

a luminescent material for emitting light of a predetermined color, used for color image display;

the luminescent material comprises at least one blue light-emitting phosphor selected from the group consisting of (Zn,Cd)S:Ag, (Zn,Cd)S:Ag,Cl, (Zn,Cd)S:Ag,Cl,Al and (Zn,Cd)S:Ag,Cl,Mg, or a green light-emitting phosphor, (Zn,Cd)S:Cu,Al,Au; and a ZnO:Zn phosphor capable of enhancing the brightness of the display, wherein the mixing ratio of the luminescent material to the ZnO:Zn phosphor is varied according to a desired level of the brightness.

2. The high-brightness phosphor screen of claim 1, wherein the amount of the ZnO:Zn phosphor added is 20% or less by weight based on the weight of the luminescent material.

3. A method for forming a high-brightness phosphor screen by mixing a luminescent material for emitting light of a predetermined color and a predetermined amount of a ZnO:Zn phosphor, the method comprising the steps of:

(a) preparing a phosphor mixture solution by dispersing the luminescent material and the ZnO:Zn phosphor in a solvent, wherein the luminescent material comprises at least one blue light-emitting phosphor selected from the group consisting of (Zn,Cd)S:Ag, (Zn,Cd)S:Ag,Cl, (Zn,Cd)S:Ag,Cl,Al and (Zn,Cd)S:Ag,Cl,Mg, or a green light-emitting phosphor, (Zn,Cd)S:Cu,Al,Au;

(b) forming a phosphor layer by depositing the phosphor mixture solution on a substrate; and (c) evaporating the solvent from the deposited phosphor layer.

4. The method of claim 3, wherein the amount of the ZnO:Zn phosphor added is 20% or less by weight based on the weight of the luminescent material.

5. The method of claim 3, wherein, in step (b), the phosphor layer is formed by depositing the phosphor mixture solution on the substrate with the application of electrophoresis, screening, photolithography or precipitation.

6. A high-brightness phosphor screen formed by the method of claim 3.

* * * * *